US008266757B2

(12) United States Patent
Jaeger

(10) Patent No.: US 8,266,757 B2
(45) Date of Patent: Sep. 18, 2012

(54) CLEANING APPARATUS

(76) Inventor: Anton Jaeger, Senden (DE)

( * ) Notice: Subject to any disclaimer, the term of this patent is extended or adjusted under 35 U.S.C. 154(b) by 1188 days.

(21) Appl. No.: 12/017,495

(22) Filed: Jan. 22, 2008

(65) Prior Publication Data

US 2008/0172810 A1 Jul. 24, 2008

(30) Foreign Application Priority Data

Jan. 23, 2007 (DE) ..... 10 2007 003 434

(51) Int. Cl.
*A47L 4/00* (2006.01)
*A46B 13/00* (2006.01)

(52) U.S. Cl. ..... 15/220.3; 15/21.1; 15/104.93; 15/102

(58) Field of Classification Search ..... 15/220.3, 15/21.1, 104.93; 401/9
See application file for complete search history.

(56) References Cited

U.S. PATENT DOCUMENTS

| | | | | |
|---|---|---|---|---|
| 2,246,036 | A | 6/1941 | Farrell | |
| 2,624,899 | A | 1/1953 | Smith | |
| 2,663,046 | A | 12/1953 | Goguen | |
| 2,816,304 | A | 12/1957 | Peterson | |
| 2,941,232 | A | 6/1960 | Milbourne | |
| 3,553,758 | A * | 1/1971 | Wood | 15/24 |
| 3,621,505 | A | 11/1971 | Vocker et al. | |
| 3,716,883 | A * | 2/1973 | Monroe | 15/1.7 |
| 3,892,004 | A | 7/1975 | Downes | |
| 4,277,861 | A | 7/1981 | Lex | |
| 5,400,468 | A | 3/1995 | De Petra et al. | |
| 6,544,631 | B1 | 4/2003 | Tanaka et al. | |
| 7,194,783 | B1 | 3/2007 | Hunt | |

FOREIGN PATENT DOCUMENTS

| | | | |
|---|---|---|---|
| AT | 333 954 | B | 3/1984 |
| CH | 520 533 | | 3/1972 |
| CH | 603 111 | | 8/1978 |
| DE | 944 149 | | 5/1956 |
| DE | 1 798 845 | | 10/1959 |
| DE | 1 932 374 | A | 1/1971 |
| DE | 1 959 225 | | 5/1971 |
| DE | 26 34 820 | | 2/1977 |
| DE | 26 34 556 | | 12/1977 |
| DE | 30 18 736 | A1 | 11/1981 |
| DE | 298 15 574 | U1 | 2/1999 |
| DE | 299 18 939 | U1 | 3/2000 |
| DE | 200 19 340 | U1 | 4/2001 |
| DE | 200 15 319 | U1 | 5/2001 |
| DE | 10330849 | | 1/2005 |
| DE | 10 2004 034 819 | B3 | 8/2005 |
| DE | 102004034819 | | 8/2005 |

(Continued)

OTHER PUBLICATIONS

European Search Report dated Sep. 4, 2009, EP 08 001 135.6.

*Primary Examiner* — Shay Karls
(74) *Attorney, Agent, or Firm* — Gifford, Krass, Sprinkle, Anderson & Citkowski, P.C.

(57) ABSTRACT

The invention relates to a cleaning apparatus, in particular to a portable hand cleaner, having a plurality of cleaning members which are in particular of brush type and which are arranged at a common carrier and can be set into rotation by means of a fluid, in particular water, supplied to the cleaning apparatus.

22 Claims, 10 Drawing Sheets

FOREIGN PATENT DOCUMENTS

Figure 1:
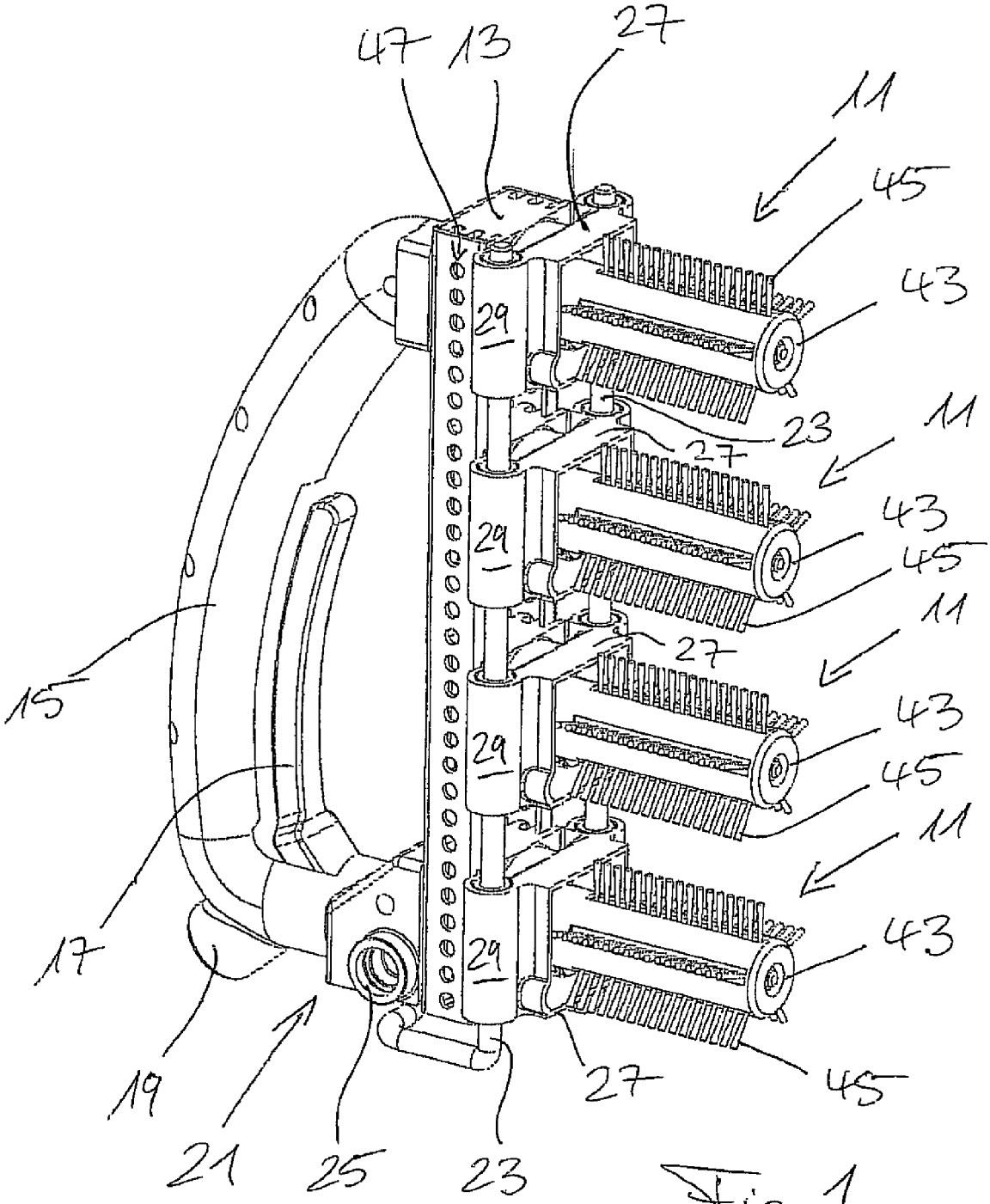

| | | | |
|---|---|---|---|
| DE | 202006017854 | U1 | 3/2007 |
| DE | 202005021418 | U | 1/2008 |
| EP | 1614377 | | 1/2006 |
| EP | 1 949 836 | A2 | 7/2008 |
| GB | 1 365 729 | | 9/1974 |
| JP | 2003325395 | | 11/2003 |

* cited by examiner

CLEANING APPARATUS

RELATED APPLICATION

This application claims priority of German Patent Application No. DE 10 2007 003 434.4 filed January 23, 2007.

The present invention relates to a cleaning or treatment apparatus, in particular a portable hand cleaner, having a plurality of cleaning or treatment members, in particular of a brush type, which are arranged at a common carrier or having at least one brush-like cleaning member which is arranged at a carrier.

Such apparatus are generally known, e.g. from DE 10 2004 034 819 B3.

It is the object of the invention to further develop an apparatus of the initially named kind such that it can be handled easily and used in a versatile manner.

A cleaning fluid can simultaneously be used as a rotation device for the cleaning members through the invention.

The kinetic energy of the supplied fluid is preferably used to act on a drive device, i.e. it is not necessary to use the recoil principle. The rotary drive of the cleaning members is in particular based on the impeller or turbine principle, i.e. the kinetic energy of the supplied fluid is utilized in that the fluid cooperates with a correspondingly designed drive device, in particular an impeller or a turbine wheel, and sets it into rotation.

It is of advantage in this connection that the drive can be coupled with differently designed cleaning parts, e.g. brush parts, independently of the design of the cleaning members and e.g. in particular within the framework of a modular construction of the cleaning apparatus in order to realized different applications.

A special feature of the invention is in particular the possible modular structure of the cleaning members. Each cleaning member preferably includes a cleaning part, which is in particular designed as a brush part and which rotates relative to the carrier of the cleaning apparatus during operation, and a drive compartment with which the cleaning part is coupled, in particular in a replaceable manner, via which the module can be attached to the carrier and which in particular serves to communicate with one or more fluid supply devices to convert the ingoing fluid into the desired rotary movement of the cleaning part. The drive part of each module in particular includes an impeller or turbine wheel which is acted on by the fluid entering into the module or into the drive part in order to be set into rotation in this manner and thus to set the cleaning part or the brush part into rotation.

A plurality of modules can be attached to a common carrier in accordance with an aspect of the invention. The number of modules is generally not limited in this connection. Restrictions can at best be given by the design of the carrier or of the fluid supply devices. The carrier or the fluid supply devices can in particular be made such that modules can only be supplied with fluid at a specific number of connection points.

One and the same module can preferably be used both together with further modules in a cleaning apparatus in which a plurality of cleaning members are provided and on its own, i.e. as the only module of a cleaning apparatus. The mode of operation of the modules is therefore in each case independent of whether additional modules are provided at the respective cleaning apparatus or not.

The modules can in each case in particular be designed such that they can be used in a pivotable manner, i.e. can be coupled to the carrier or to the fluid supply device in two different orientations. Different directions of rotation of the cleaning part with respect to the carrier can be achieved simply in this manner in that the module is coupled to the carrier or to the fluid supply device either in the one or the other orientation. A different direction of the action of an impeller or turbine wheel of the module provided in the drive device then in particular results in dependence on the orientation. When a plurality of modules are used, it is furthermore possible to couple a module to the carrier or to the fluid supply device in a first orientation and a further module in a second orientation. Two simultaneously operated modules can be operated in opposite senses in this manner, whereby torques arising during the use at least party cancel one another and a "migration effect" of the cleaning apparatus during use is largely avoided.

Possible further developments of the invention are set forth in the dependent claims, in the description and in the drawing.

Figure 2:
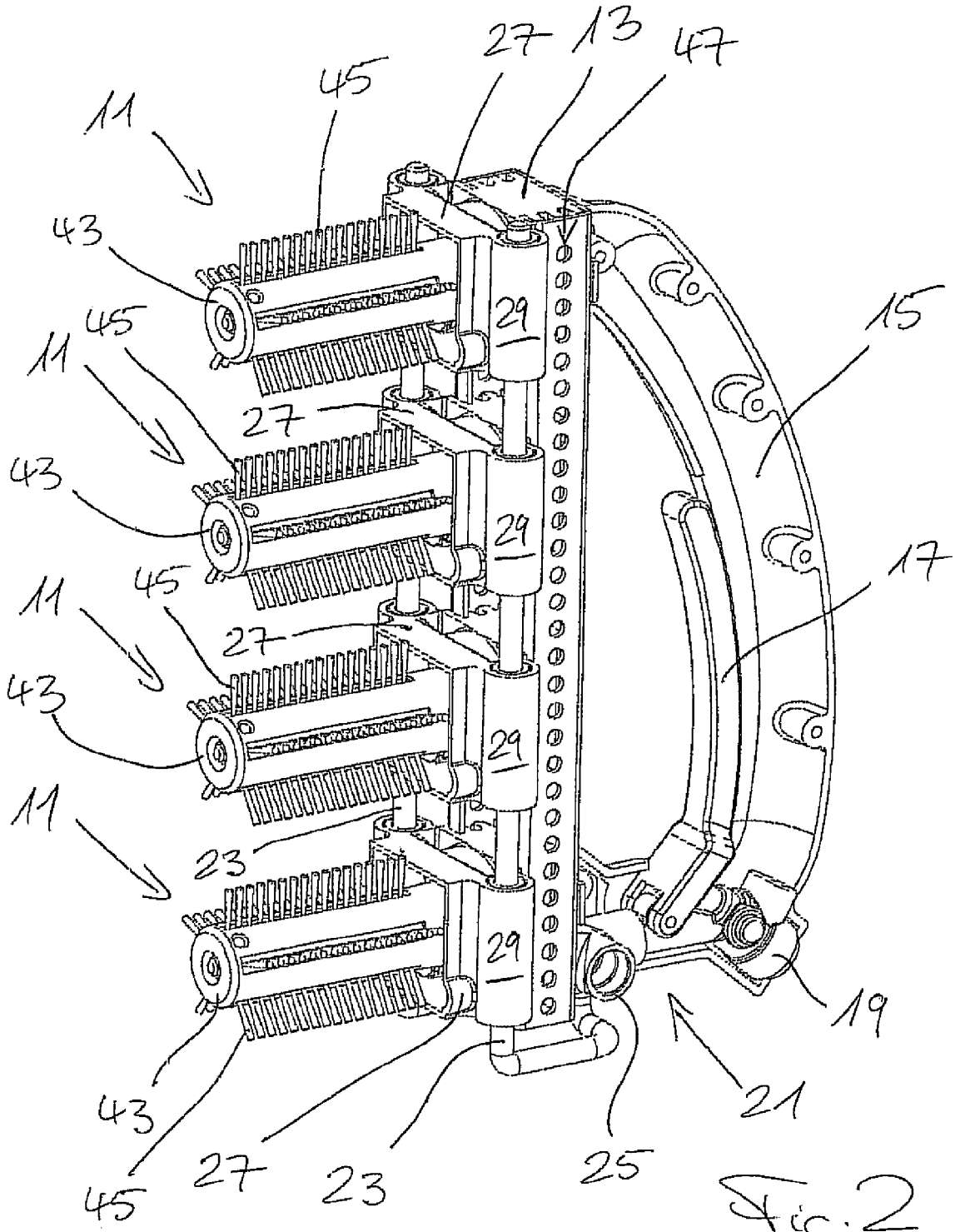
Figure 3:
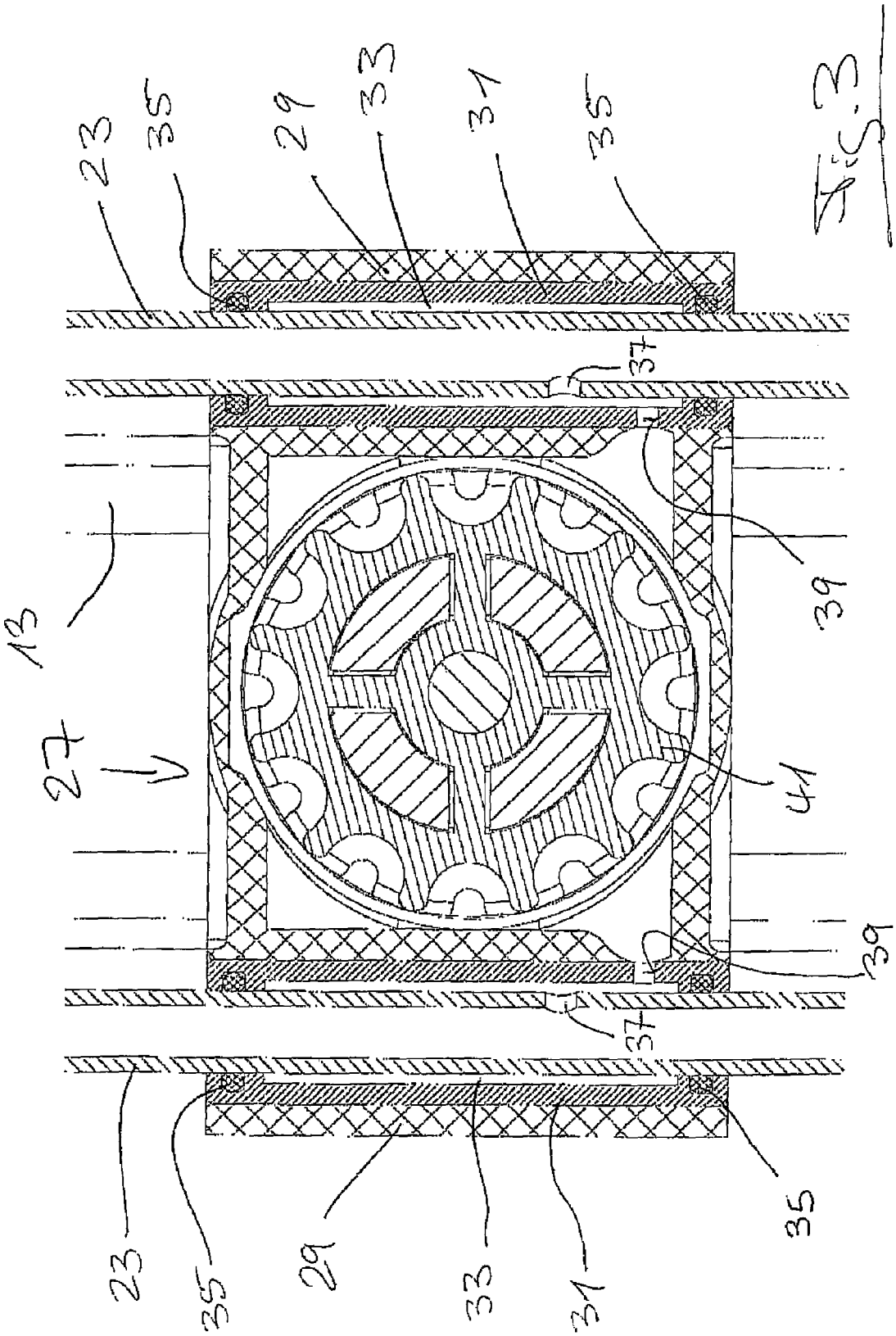
Figure 4:
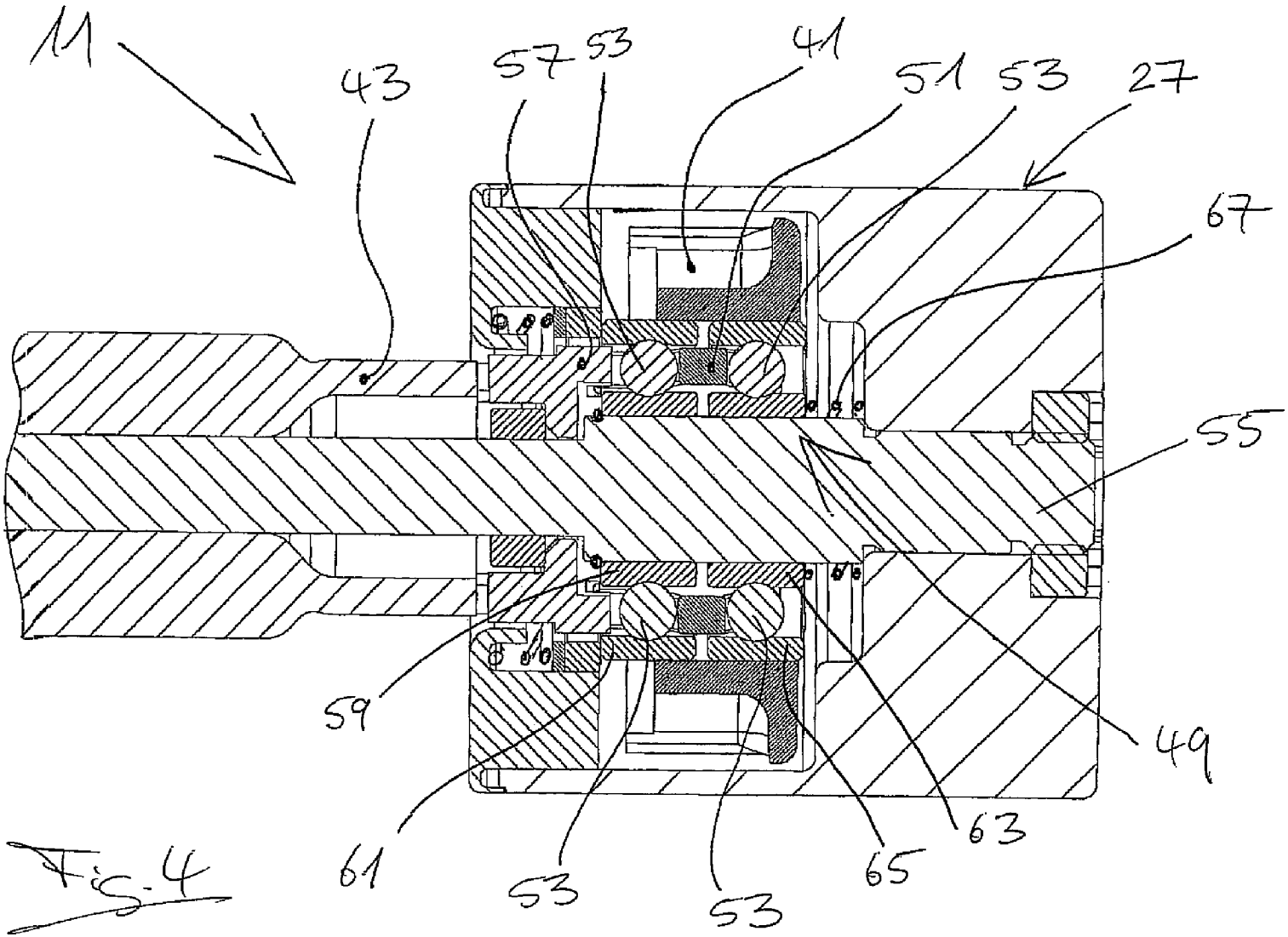
Figure 5:
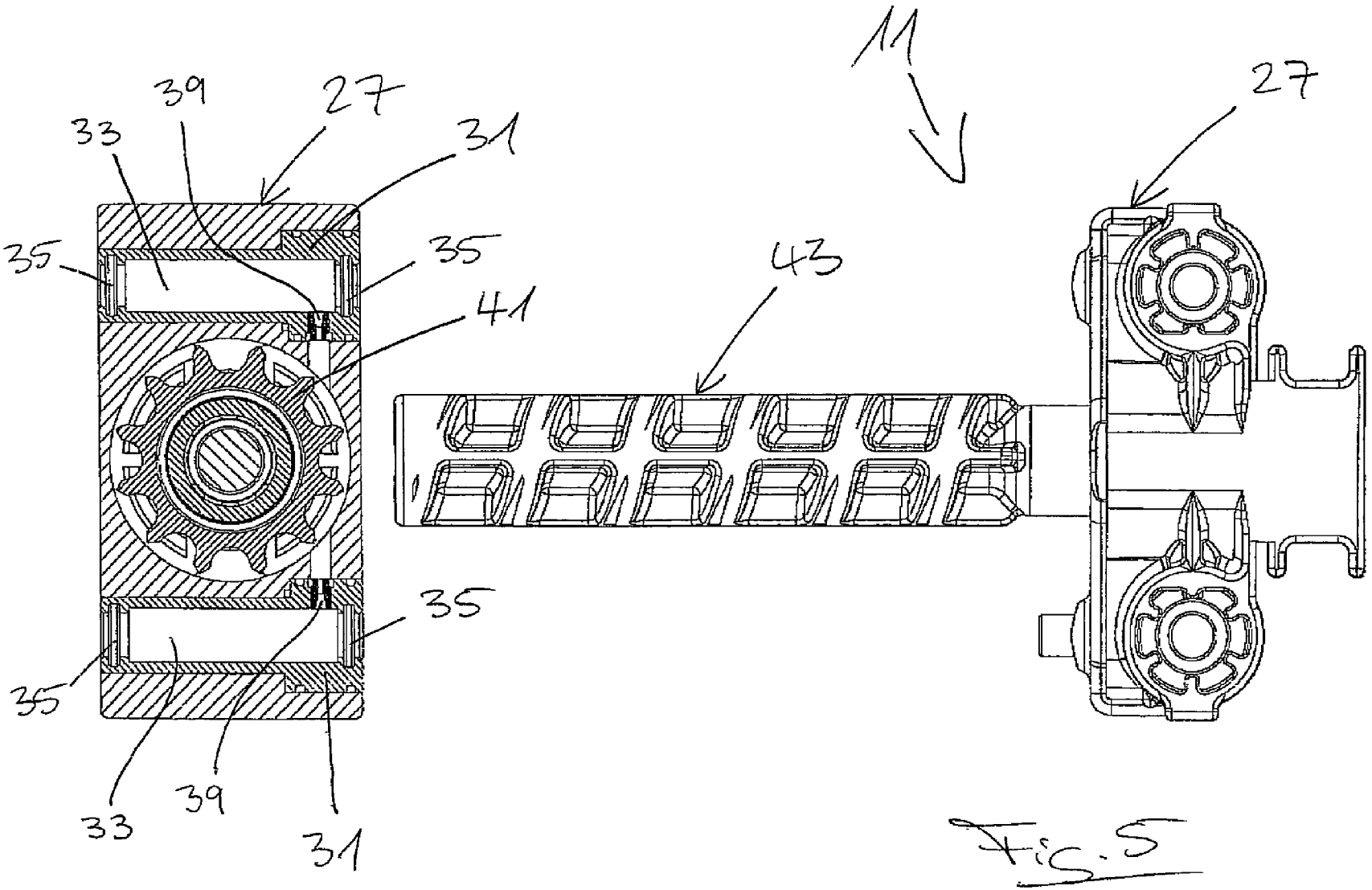

The invention will be described in the following by way of example with reference to the drawing:

There are shown:

FIG. 1 a perspective view of an embodiment of a cleaning apparatus in accordance with the invention;

FIG. 2 another perspective view of the cleaning apparatus of FIG. 1;

FIG. 3 a drive device of the cleaning apparatus of FIG. 1;

FIG. 4 a possible embodiment for a drive device in accordance with the invention provided with a transmission;

FIG. 5 two views of a further embodiment of a cleaning apparatus in accordance with the invention; and FIGS. 6 to 11 further possible aspects of a cleaning apparatus in accordance with the invention.

The cleaning apparatus shown in FIGS. 1-3 is a slat cleaner or Venetian blind cleaner having four cleaning members in the form of brushes 11 which are arranged spaced apart from one another in a row along a common elongated carrier 13. The carrier 13 is in particular a sheet metal section.

A handle 15 comprising two half-shells and in particular made of plastic is connected to the carrier 13. The cleaning apparatus is designed such that it can be held in one hand and operated by one person during operation. An actuation device 17 in the form of a trigger lever is provided at the handle 15 and the fluid supply to the brushes 11 described in the following can be released and interrupted using said trigger lever.

The supply of the fluid, in particular water, takes place via a fluid inlet 19 which is arranged in the lower handle region and to which a fluid line made, for example, as a tube, can be connected.

The fluid flows via a distributor device 21 into one of two distributor lines 23 which extend parallel to one another along the carrier 13 and thus at both sides along the row of cleaning brushes 11. The user can supply the fluid either to the one or to the other distributor line 23 by switching over at the distributor device 21. The cleaning brushes 11 can hereby be operated selectively in the one or the other direction of rotation, which will be looked at in detail in the following. The distributor lines 23 are closed in a fluid tight manner at their free ends remote from the distributor device 21.

The switching over at the distributor device 21 takes place, for example, in that a movably supported slider is provided which can be displaced via switchover buttons 25 arranged at both sides and shown without seal in FIGS. 1 and 2. The position of the slider then determines the direction of rotation of the brushes 11.

As can in particular be seen from FIG. 3, which shows a section perpendicular to the axes of rotation of the cleaning brushes 11 and along the central axes of the distributor lines 23, each cleaning member 11 includes a housing-like carriage 27 which is open to the front and has a sleeve-like section 29 at mutually opposite sides with which the carriage 27 is pushed over the respective distributor line 23.

An inner sleeve 31 acting as a pressure cartridge is arranged inside each sleeve-like section 29. The pressure cartridges 31 are each designed such that, together with the outer wall of the respective distributor line 23, they bound a pressure space 33 which is outwardly sealed in each case by an O ring 35 at the ends of the pressure cartridges 31. Both an inlet opening 37 formed in the distributor line 23 and a drive opening 39 formed in the pressure cartridge communicate with the pressure space 33.

The drive opening 39 is designed, arranged and aligned such that fluid flowing via the drive opening 39 from the pressure space 33 into the carriage housing in incident in the form of a pressure fluid jet onto a turbine wheel section or impeller section 41 of the respective cleaning member 11 and in this manner sets the cleaning member 11 into rotation which is rotatably supported at the carriage 27 for this purpose.

The rotatable support of the impeller section or turbine wheel section 41 can e.g. take place via a simple hub/axle connection. Alternatively, ball bearings can be used, for example. It is furthermore possible to provide a transmission with which a step-up or step-down of the rotation of the impeller or turbine wheel 41 can be realized which corresponds to the respective application demands.

A cylindrical brush 43, which is elongated in the embodiment shown here and is provided with cleaning bristles 45, is coupled to the impeller or turbine wheel 41. Alternatively, for example, disk-shaped plate brushes can be provided instead of these brushes 43. The cleaning apparatus can be realized in modular construction such that the cylindrical brushes 11 shown can be replaced as required by the mentioned plate brushes or other cleaning members. The versatility of the apparatus is increased in a simple manner by such a replacement possibility.

An advantage of the invention consequently consists of the drive of the cleaning members being independent of its embodiment. In particular a special embodiment of the cleaning members or brushes with respect to the cleaning effect is not a requirement for the fluid rotation drive since it takes place at the end of the axis of rotation of the cleaning members 11 close to the carrier.

It is also conceivable to provide an impeller section or turbine wheel section which always remains at the carriage 27 and to design differently configured brush sections to be able to be coupled, for example, by plugging on, to the impeller or turbine wheel in order to be able to configure or equip the cleaning apparatus in accordance with the respective application.

A rotationally fixed coupling between replaceable brush parts and the impeller sections or turbine wheel sections rotatably supported at the carriage can be achieved, for example, by a suitably designed crowning which ensures a taking along of the brush parts.

It can in particular be seen from FIG. 3 that the modules, that is the respective carriages 27 supporting the cleaning member 11, are adjustable along the distributor lines 23 in order to set different spacings between the cleaning brushes 11 in this manner. When the cleaning apparatus is configured as a slat or Venetian blind cleaner in accordance with FIGS. 1 to 3, the brush spacing can hereby be adapted to the slat spacing.

The vertical adjustment of the carriages 27 is in each case possible to the amount of the axial extent of the pressure space 33 defined by the pressure cartridge 31, i.e. as long as the inlet openings 37 formed in the distributor lines 23 are in the region of the respective pressure space 33, the function of the cleaning members 11 is ensured.

As can in particular be seen from FIG. 3 it is possible to switch between the directions of rotation of the cleaning brushes 11 by the provision of two distributor lines 23 between which a switch can be made by means of the distributor device 21—as explained above. The two drive bores 39 of each carriage 27 act on the impeller or turbine wheel 41 in opposite senses of rotation. The vanes of the impeller or turbine wheel 41 are made symmetrical in this respect so that the same conditions apply in both directions of rotation.

The structure of the cleaning apparatus from an elongated carrier 13 with distributor lines 23 extending along the carrier 13 generally enables a working length of any desired size and thus generally any desired number of cleaning members 11.

The bore rows 47 provided in the carrier 13 can provide a grid for the positioning of the carriages 27 in the vertical adjustment. The grid of the bore rows 47 can be adapted to customary slat spacings of Venetian blinds.

In an embodiment only set forth by way of example here, the hand cleaner in accordance with the invention is designed for an operating pressure of at least 50 bar, with speeds of approximately 1,500 rpm being achieved for the cleaning brushes 11. An operating pressure of up to 100 bar is equally easily conceivable. The speed can, for example, be halved by means of a transmission.

Means, e.g. in the form of one or more ramps arranged in the lower region, can be provided in the carriage housings which are open to the front, said means promoting an outflow of the fluid from the housing and toward the points to be cleaned into the area of action of the brushes 11.

FIG. 4 shows an example for a transmission 49 such as was already generally mentioned above in a sectioned side view. In the embodiment shown, it is a step-down transmission which halves the speed of the impeller 41 for the cleaning part or brush part 43 of the cleaning member 11. The turbine wheel 41 is rotationally fixedly provided with two external rings 61, 65. A single external ring, throughgoing in the axial direction, could also be provided instead of two external rings 61, 65. Furthermore, the two external rings 61, 65 or a single external ring could be made in one piece with the impeller 41. The external rings 61, 65 form the external part of a spherical bearing which moreover includes a cage 51 in which a plurality of balls 53 are held such that all the balls 53 can only rotate together with the cage 51.

Two internal rings 59, 63 form the inner part of the ball bearing. The two internal rings 59, 63 are rotationally fixedly arranged on a stationary shaft 55 serving as a bearing. At least the second internal ring 63 at the right in FIG. 4 is movable in the axial direction on the shaft 55. The second internal ring 63 is biased in the direction of the first internal ring 59 by means of a spring 67. Since the balls 53 run in grooves formed on the inner sides of the rings 59, 61, 63, 65 facing one another, any possible play in the ball bearing is eliminated by this bias of the right hand internal ring 63. It is hereby ensured that during operation, when the impeller 41 is acted on by fluid and thus rotates around the shaft 55, the balls 53 held in the cage 51 roll off in a defined manner between the external rings and the internal rings.

The defined rolling off of the balls 53 has the consequence that the above-described arrangement is active as a step-down transmission which halves the speed of the impeller 41 with respect to the cage 51 containing the rolling off balls 53. An intermediate piece 57 which is itself rotationally fixedly connected to the brush part or cleaning part 43 is rotatably supported at the drive part 27 around the bearing shaft 55 and is rotationally fixedly connected to the cage 51. The result is thus achieved with this cleaning member 11 that the respective brush of the cleaning member 11 rotates half as fast as the impeller 41.

A particular advantage of this transmission 49, in addition to the reliable operation, is the particularly simple design which can be realized with components available at a favorable price. Such a step-down transmission could alternatively be realized in the form of a transmission made up of gears, in particular of a planetary transmission. The components required for this purpose would, however, be associated with much higher costs.

The left hand representation in FIG. 5 corresponds to the representation in FIG. 3, with the module 27, 43, however, not being shown together with the fluid supply lines. It is therefore not the inlet openings formed in the fluid lines and opening into the respective pressure space 33 which can be seen, but only the drive openings 39 formed in the inner sleeves 31 forming the pressure cartridges.

In particular the symmetrical design of the module consisting of the drive part 27 and the cleaning part 43 with respect to the arrangement of the fluid supply lines relative to the cleaning part 43 can be seen from the plan view shown in the right hand representation of FIG. 5

Figure 6:
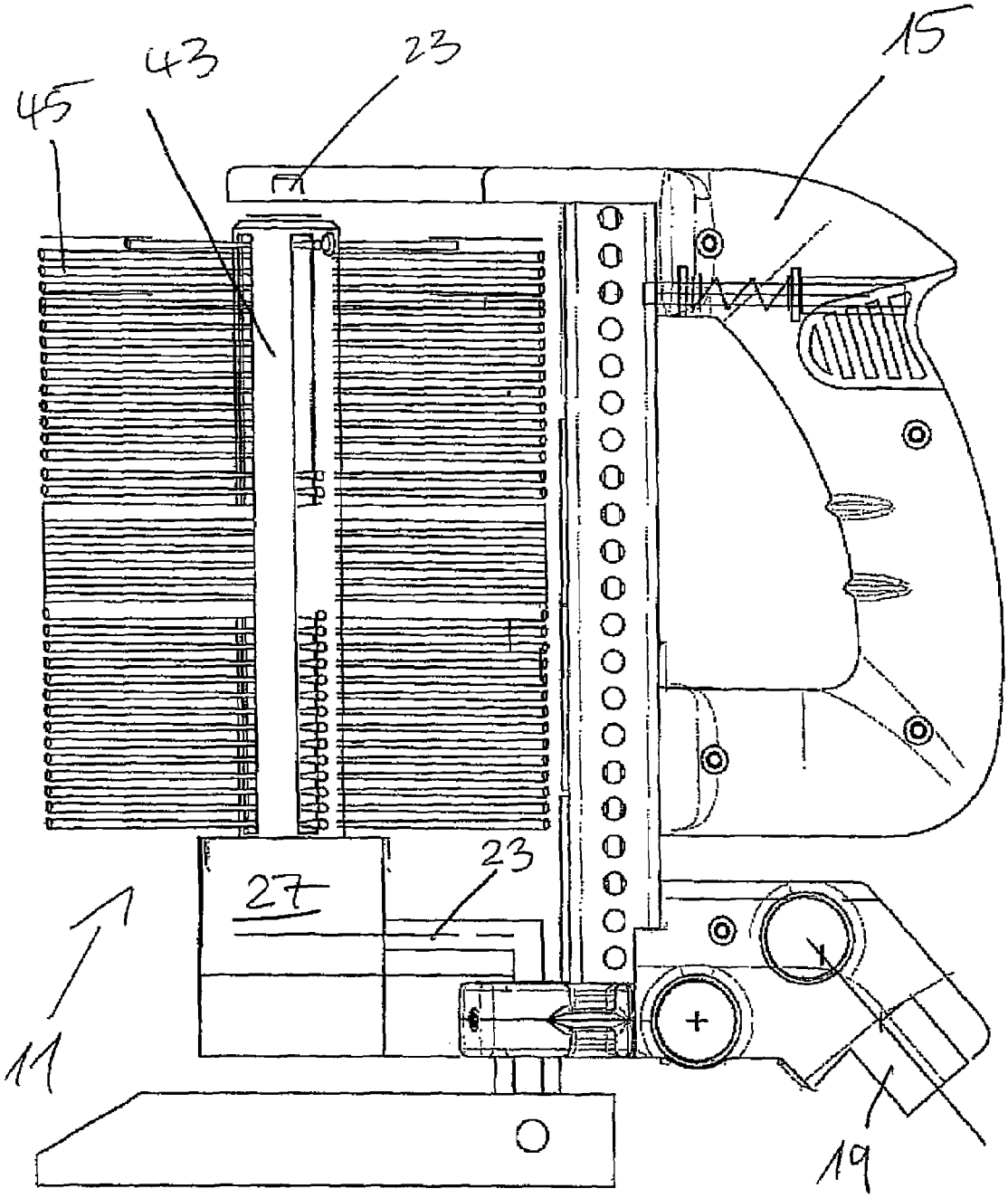

FIG. 6 shows a possible embodiment of a cleaning apparatus in which only one module is used. When the apparatus is held at the handle 15 in accordance with its purpose, the axis of rotation of the brush part 43 extends in the vertical direction. This embodiment shows that the operation of the cleaning member 11 is generally independent of its orientation in space. In addition, in particular the advantages of the modular construction in accordance with the invention are shown here: Independently of how the fluid supply lines 23 extend in space, the cleaning module in accordance with the invention only has to be pushed onto the line 23 with the drive part 27 including the drive device to provide a rotation of the brush part 43. The free end of the supply line 23 is only rotatably supported in an upper arm of the apparatus.

Figure 7:
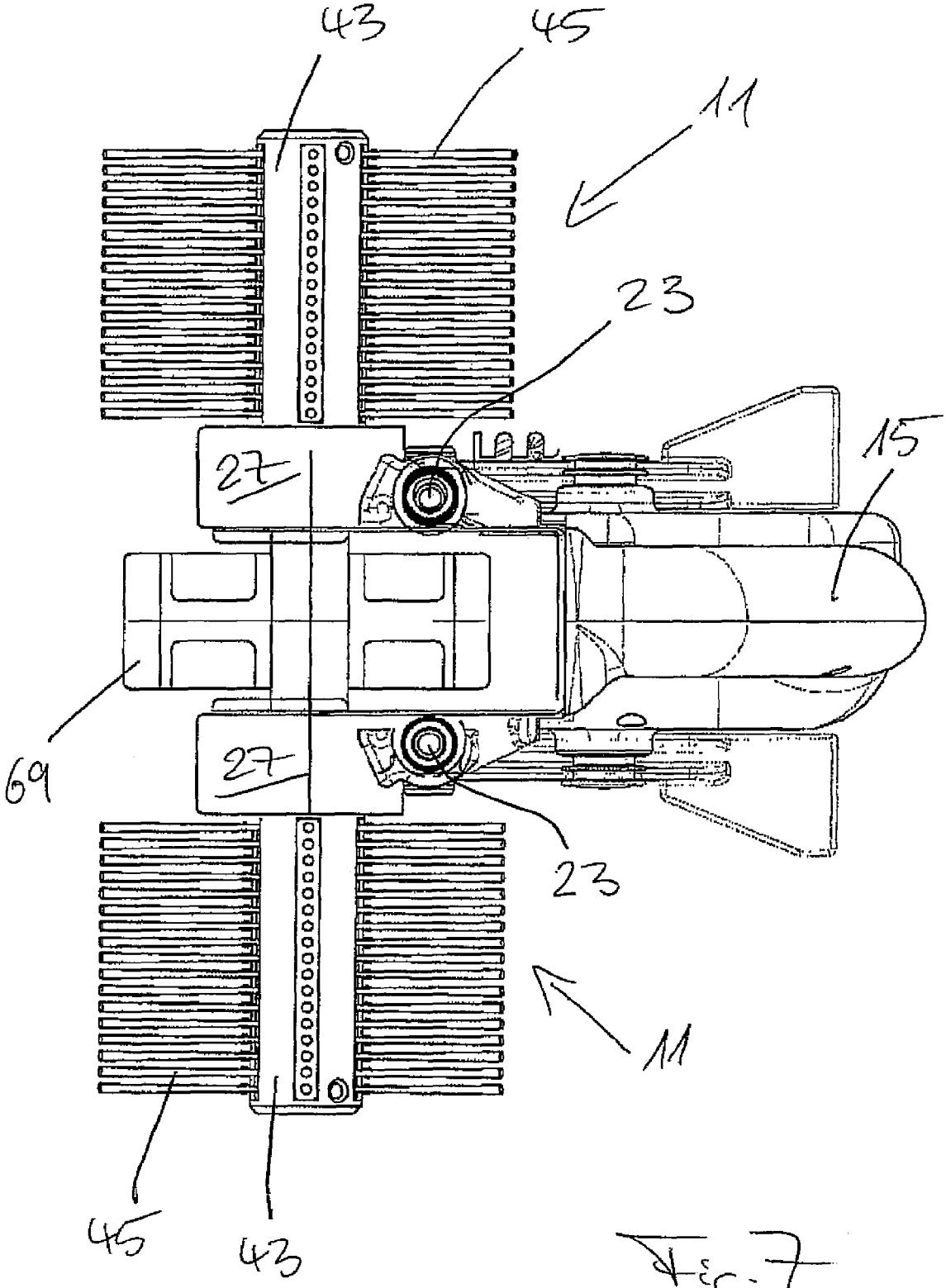

FIG. 7 shows a further embodiment in which two cleaning modules are present which project in opposite directions, with the axes of rotation of the cleaning parts 43 coinciding and extending in a horizontal direction with a holding of the apparatus at the handle 15 in accordance with its purpose, but—unlike in FIG. 1—not facing away from the user, but to the side in each case. The drive part 27 of each module is pushed onto a single fluid supply line 23.

A support wheel 69 is arranged between the two modules. The support wheel 69 is not driven and serves to roll off the apparatus on a surface to be cleaned. The strain on the user is hereby reduced. At the same time, a defined cleaning spacing is observed between the surface to be cleaned, on the one hand, and the axes of rotation of the cleaning parts 43, on the other hand.

Figure 8:
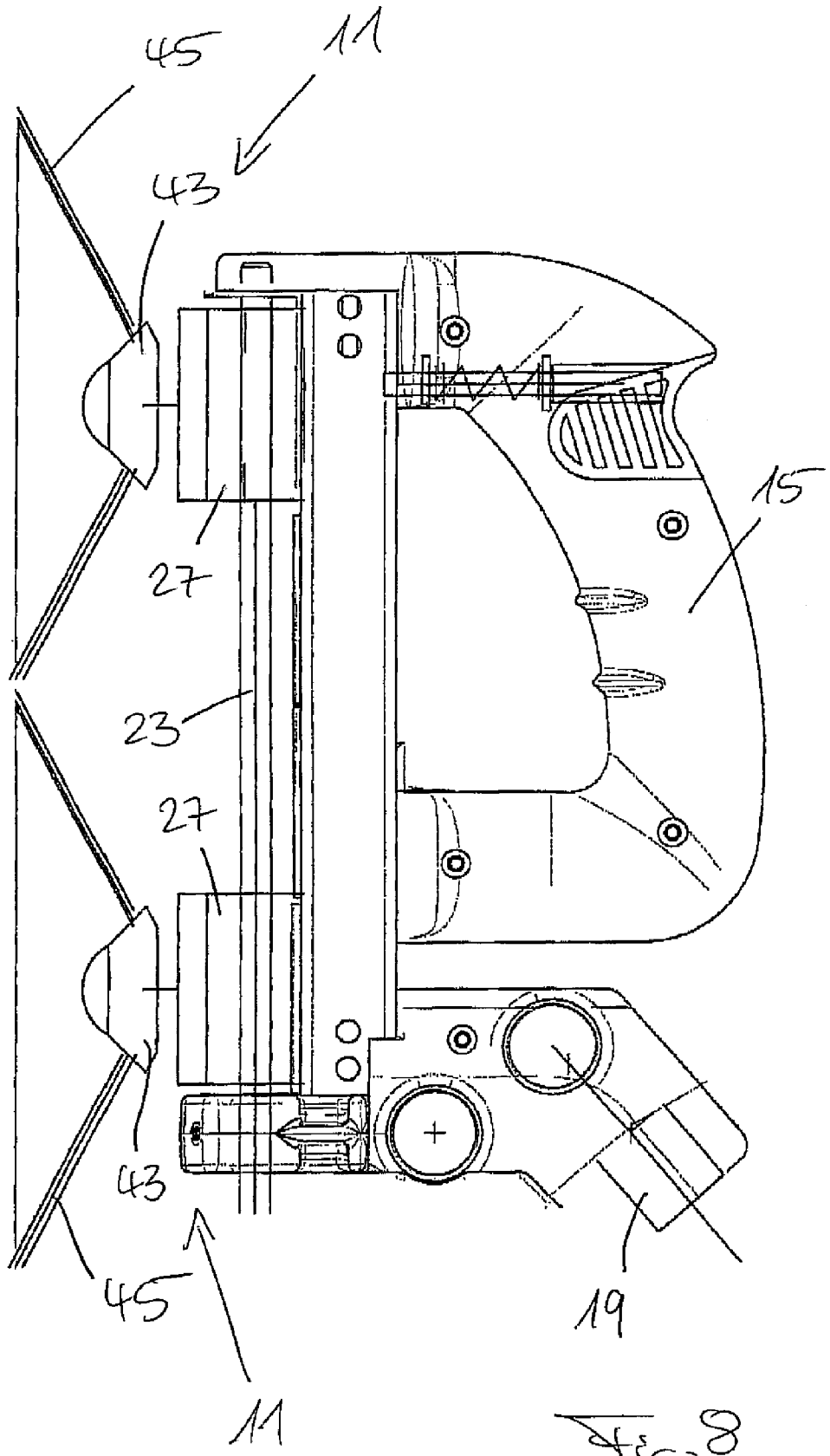

The embodiment of FIG. 8 is similar to the embodiment of FIG. 1 with respect to the orientation of the axes of rotation of the cleaning parts 43. So-called plate brushes are provided here instead of the cylindrical brushes. The two modules can be pushed onto two fluid supply lines 23 extending in parallel in accordance with the embodiment of FIG. 1 to change the sense of rotation of the cleaning parts 43 by actuation of a corresponding switch-over device. This is, however, not compulsory, i.e. it is also possible to provide only a single fluid supply line 23. Identically designed modules 27, 43 can be coupled to the fluid supply line 23 in an opposite orientation to rotate in the opposite sense during operation.

Figure 9:
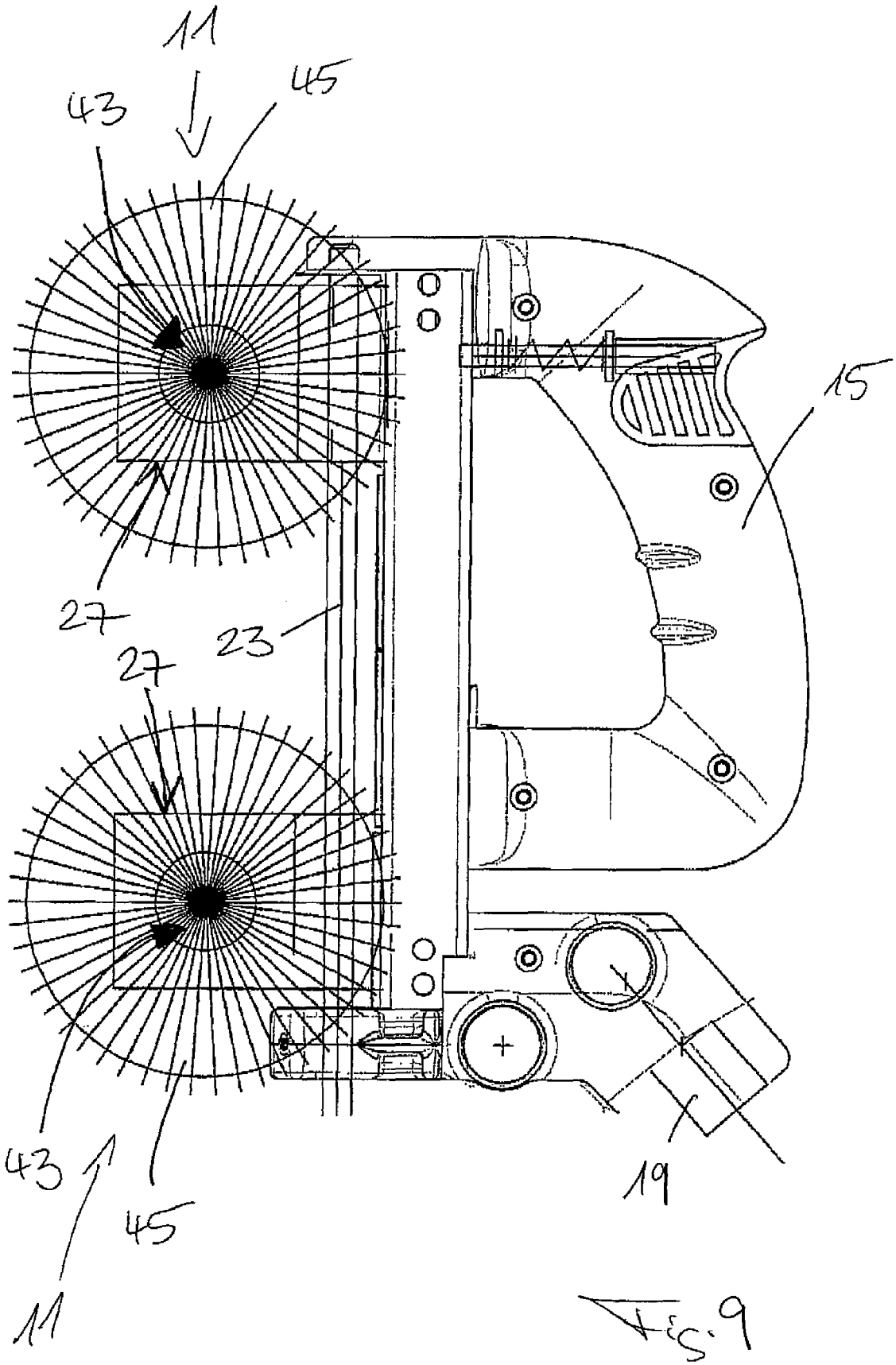

The embodiment of FIG. 9 is similar to the embodiment of FIG. 8, but with work not taking place from the front—seen from the user—with the plate brushes, but to the side. The modules 27, 43 can be designed such that they can be adjusted relative to the fluid supply line 23 around its central axis to be able to set the working direction of the plate brushes as desired with respect to the orientation of the handle 15 of the apparatus. Alternatively, the modules 27, 43 and the apparatus can be made such that a specific relative orientation is required on the connection of the modules 27, 43 to the fluid supply lines 23 to realize the shown operating orientation of the plate brushes 43.

Figure 10:
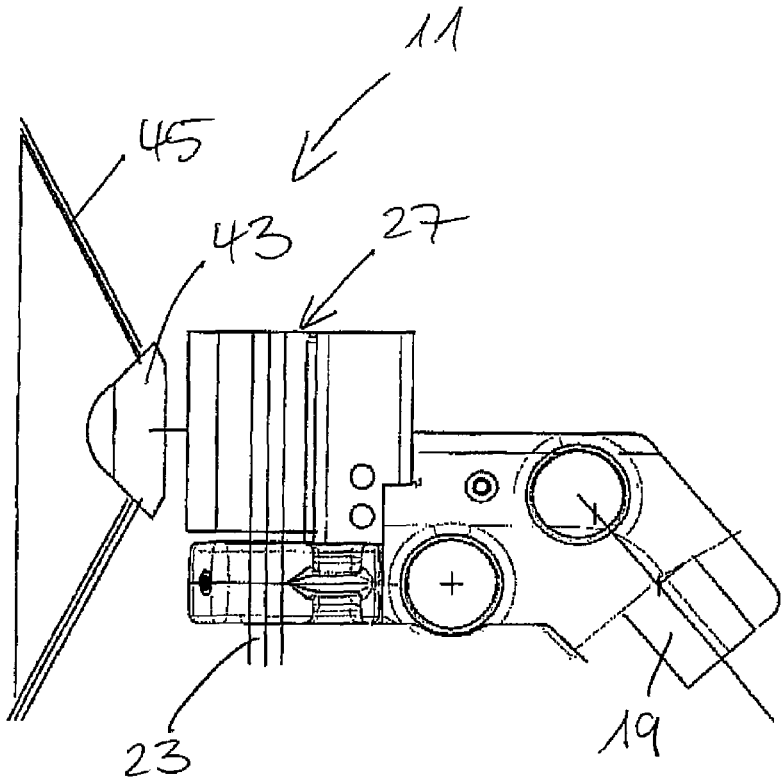
Figure 11:
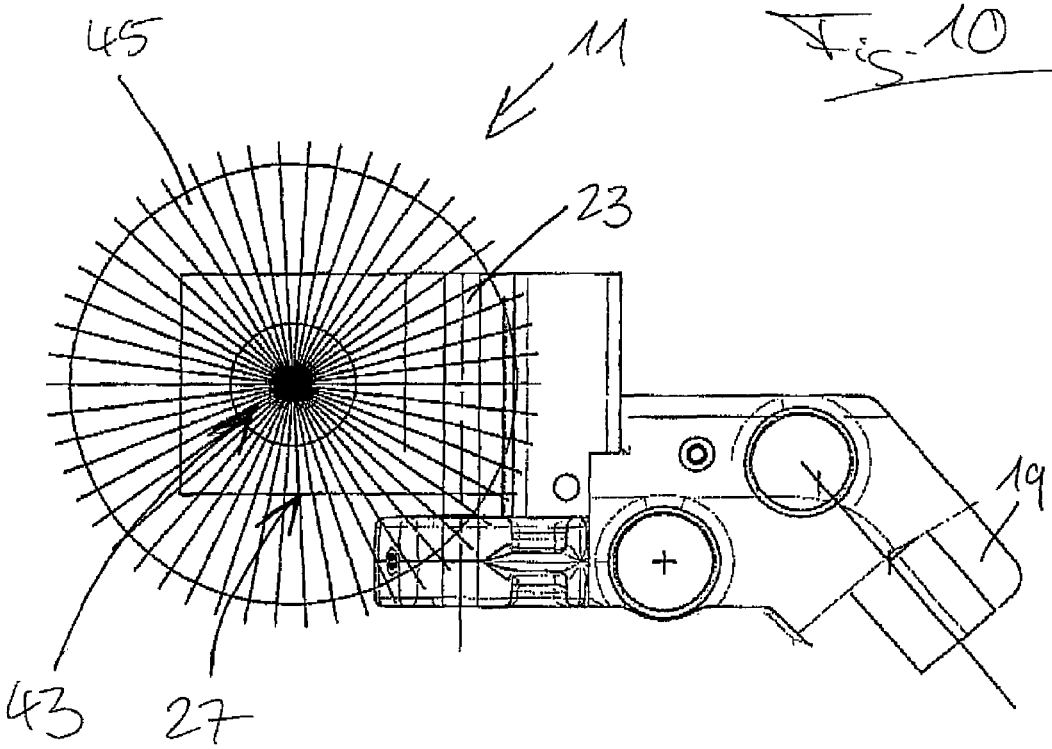

FIGS. 10 and 11 indicate that the use of a plurality of cleaning members, such as is shown in FIG. 8 and FIG. 9, is not absolutely necessary. The cleaning apparatus in accordance with the invention can also have only a single cleaning member 11, with different working directions of the brush part being possible in dependence on the design of the cleaning member 11 or of the apparatus.

REFERENCE NUMERAL LIST

11 cleaning member, brush
13 carrier
15 handle
17 actuation device
19 fluid inlet
21 distributor device
23 distributor device, fluid supply device
25 switch-over button
27 carriage, drive part
29 sleeve-shaped section
31 inner sleeve, pressure cartridge
33 pressure space
35 O ring
37 inlet opening
39 drive opening
41 impeller section or turbine wheel section
43 brush part, cleaning part
45 cleaning bristles
47 bore row
49 transmission
51 cage
53 ball or roller element
55 bearing
57 intermediate piece
59 first internal ring
61 first external ring
63 second internal ring
65 second external ring
67 biasing spring
69 support wheel

The invention claimed is:

1. A cleaning apparatus, in particular a portable hand cleaner, having a plurality of cleaning members (11) which are of brush type and which are arranged at a common carrier (13) and can be set into rotation relative to the carrier (13) by means of a fluid supplied to the cleaning apparatus, wherein a drive device (41) is provided which can be acted on by the supplied fluid to set the cleaning members (11) into rotation, wherein drive device (41) is provided for each cleaning member (11), wherein the rotation drive (41) of the cleaning members (11) includes an impeller, wherein cleaning members (11) are adjustable relative to one another, wherein the carrier (13) has a longitudinal extent and the cleaning members (11) are arranged distributed along the carrier (13), with the cleaning members (11) being adjustable relative to one another in the longitudinal direction of the carrier (13) to set different spacings between adjacent cleaning members (11), wherein the cleaning members (11) each include a brush part (43) and said drive device (41) with the brush part (43) being coupled or being able to be coupled replaceably with the drive device (41), wherein said brush part (43) and drive device (41) are coaxially rotatable.

2. A cleaning apparatus in accordance with claim 1, characterized in that the cleaning members (11) are arranged in a row.

3. A cleaning apparatus in accordance with claim 1, characterized in that the carrier (13) includes a fluid distributor (23) which has at least one common fluid inlet (19) for a plurality of cleaning members (11) and at least one fluid outlet (37) for each cleaning member (11).

4. A cleaning apparatus in accordance with claim 1, characterized in that the carrier (13) includes at least one fluid supply pipe (23).

5. A cleaning apparatus in accordance with claim 1, characterized in that a switch-over device (25) is provided with which the direction of rotation of each cleaning member (11) can be varied.

6. A cleaning apparatus in accordance with claim 1, characterized in that each cleaning member (11) is coupled to two fluid supply devices (23) between which a switchover can be made and which are able to act on drive devices (41) of the cleaning members (11) with fluid in opposite senses of driving.

7. A cleaning apparatus in accordance with claim 1, characterized in that drive devices (41) of the cleaning members (11) each include a transmission (49) with which the speed of an impeller or turbine wheel (41) acted on by fluid for the cleaning member (11) is varied.

8. A cleaning apparatus in accordance with claim 7, characterized in that the transmission (49) includes a ball bearing or a roller bearing (51, 53).

9. A cleaning apparatus in accordance with claim 8, characterized in that the ball bearing or roller bearing includes a cage (51) in which a plurality of ball elements or roller elements (53) are held which roll off between the impeller or turbine wheel (41) and a bearing (55) and take along the cage (51) in so doing, with the cleaning member (11) being rotationally fixedly coupled to the cage (51).

10. A cleaning apparatus in accordance with claim 1, characterized in that the cleaning members (11) each include at least one pressure cartridge (31) which communicates with a fluid supply device (23) at the inlet side and with a drive device (41) of the cleaning member (11) at the output side, with the fluid communication being maintained within limits determined by the dimensions of the pressure cartridge (31) on an adjustment of the cleaning member (11) relative to the fluid supply device (23).

11. A cleaning apparatus in accordance with claim 1, characterized in that the cleaning apparatus is made as a Venetian blind cleaner.

12. A cleaning apparatus, in particular a portable hand cleaner, having at least one brush-like cleaning member (11) which is arranged at a carrier (13) and can be set into rotation by means of a fluid supplied to the cleaning apparatus, with the cleaning member (11) including a drive device (41) which can be acted on by the supplied fluid to set the cleaning member (11) into rotation, wherein the ball bearing or roller bearing includes a cage (51) in which a plurality of ball elements or roller elements (53) are held which roll off between the impeller or turbine wheel (41) and a bearing (55) and take along the cage (51) in so doing, with the cleaning member (11) being rotationally fixedly coupled to the cage (51).

13. A cleaning apparatus in accordance with claim 12, characterized in that the drive device (41) of the cleaning member (11) is based on the impeller or turbine principle.

14. A cleaning apparatus in accordance with claim 12, characterized in that the carrier (13) includes a fluid distributor (23) which has at least one common fluid inlet (19) for a plurality of cleaning members (11) and at least one fluid outlet (37) for each cleaning member (11).

15. A cleaning apparatus in accordance with claim 12, characterized in that the carrier (13) includes at least one fluid supply pipe (23).

16. A cleaning apparatus in accordance with claim 12, characterized in that a switch-over device (25) is provided with which the direction of rotation of each cleaning member (11) can be varied.

17. A cleaning apparatus in accordance with claim 12, characterized in that each cleaning member (11) is coupled to two fluid supply devices (23) between which a switchover can be made and which are able to act on drive devices (41) of the cleaning members (11) with fluid in opposite senses of driving.

18. A cleaning apparatus in accordance with claim 12, characterized in that the cleaning brushes (11) each include a brush part (43) and a drive device (41), which is of an impeller or turbine wheel part, with the brush part (43) being coupled or being able to be coupled replaceably with the drive device (41).

19. A cleaning apparatus in accordance with claim 12, characterized in that drive devices (41) of the cleaning members (11) each include a transmission (49) with which the speed of an impeller or turbine wheel (41) acted on by fluid for the cleaning member (11) is varied.

20. A cleaning apparatus in accordance with claim 12, characterized in that the transmission (49) includes a ball bearing or a roller bearing (51, 53).

21. A cleaning apparatus in accordance with claim 12, characterized in that the cleaning members (11) each include at least one pressure cartridge (31) which communicates with a fluid supply device (23) at the inlet side and with a drive device (41) of the cleaning member (11) at the output side, with the fluid communication being maintained within limits determined by the dimensions of the pressure cartridge (31) on an adjustment of the cleaning member (11) relative to the fluid supply device (23).

22. A cleaning apparatus in accordance with claim 12, characterized in that the cleaning apparatus is made as a Venetian blind cleaner.

* * * * *

UNITED STATES PATENT AND TRADEMARK OFFICE

CERTIFICATE OF CORRECTION

PATENT NO. : 8,266,757 B2
APPLICATION NO. : 12/017495
DATED : September 18, 2012
INVENTOR(S) : Anton Jaeger It is certified that error appears in the above-identified patent and that said Letters Patent is hereby corrected as shown below:

Title Page:

Item 30

Foreign Application Priority Data-

Delete "10 2007 003 434", Insert --10 2007 003 434.4--

Item 56

Foreign Patent Documents-

Delete "AT 333954 B", Insert --AT 383954 B--

Delete "DE 10330849", Insert --DE 10330649--

Signed and Sealed this
Twelfth Day of May, 2015

Michelle K. Lee

Michelle K. Lee
*Director of the United States Patent and Trademark Office*